US005742223A

United States Patent [19]

Simendinger, III et al.

[11] Patent Number: 5,742,223

[45] Date of Patent: Apr. 21, 1998

[54] LAMINAR NON-LINEAR DEVICE WITH MAGNETICALLY ALIGNED PARTICLES

[75] Inventors: William H. Simendinger, III; Charles A. Boyer, both of Raleigh; Rudolf R. Bukovnik, Chapel Hill, all of N.C.

[73] Assignee: Raychem Corporation, Menlo Park, Calif.

[21] Appl. No.: 568,716

[22] Filed: Dec. 7, 1995

[51] Int. Cl.[6] ..... H01C 7/10

[52] U.S. Cl. ..... 338/21; 338/22 R; 338/20

[58] Field of Search ..... 338/20, 21, 22 R, 338/225 D; 252/510, 513

[56] References Cited

U.S. PATENT DOCUMENTS

| | | | |
|---|---|---|---|
| Re. 32,898 | 4/1989 | Dechelette | 439/395 |
| 1,457,249 | 5/1923 | Janson et al. . | |
| 1,470,788 | 10/1923 | Weeks . | |
| 1,901,893 | 3/1933 | Brodie . | |
| 2,332,392 | 10/1943 | Minter | 201/64 |
| 2,707,223 | 4/1955 | Hollman | 338/32 R |
| 3,020,260 | 2/1962 | Nelson | 260/46.5 |
| 3,254,181 | 5/1966 | Lemieux | 200/115 |
| 3,281,625 | 10/1966 | Wanaselja | 317/9 |
| 3,340,431 | 9/1967 | Wanaselja | 317/9 |
| 3,349,164 | 10/1967 | Wyatt | 174/73 |
| 3,380,013 | 4/1968 | Kron et al. | 339/97 |
| 3,522,570 | 8/1970 | Wanaselja | 337/28 |
| 3,535,582 | 10/1970 | Kawiecki | 315/36 |
| 3,535,779 | 10/1970 | Wanaselja | 29/622 |
| 3,605,072 | 9/1971 | Driscoll | 339/98 |
| 3,703,700 | 11/1972 | Hasselbohm | 393/198 R |
| 3,755,615 | 8/1973 | Paullus et al. | 174/76 |
| 3,761,868 | 9/1973 | Krone et al. | 339/98 |
| 3,791,711 | 2/1974 | Jonassen | 317/20 |
| 3,813,577 | 5/1974 | Kawiecke | 317/16 |
| 3,828,219 | 8/1974 | Dumas et al. | 313/325 |
| 3,828,290 | 8/1974 | Kawiecki | 337/186 |
| 3,852,566 | 12/1974 | Quirk | 219/311 |

(List continued on next page.)

FOREIGN PATENT DOCUMENTS

| | | | |
|---|---|---|---|
| 0 603 565 | 6/1994 | European Pat. Off. | H01C 7/10 |
| 2 622 058 | 4/1989 | France | H01R 13/62 |
| 55-162201 | 12/1980 | Japan | H01C 7/10 |
| 5-3104 | 1/1993 | Japan | H01C 7/10 |
| 1346851 | 2/1974 | United Kingdom | H01C 7/10 |
| 2 129 630 | 5/1984 | United Kingdom | H01R 4/24 |
| WO86/01634 | 3/1986 | WIPO | H01B 7/18 |
| WO88/00603 | 1/1988 | WIPO | C08L 53/02 |
| WO90/05166 | 5/1990 | WIPO | C08L 53/00 |
| WO91/05014 | 4/1991 | WIPO | C08L 53/00 |
| WO93/23472 | 11/1993 | WIPO | C08L 53/02 |
| WO 94/00856 | 1/1994 | WIPO | H01C 7/12 |

OTHER PUBLICATIONS

U.S. application No. 08/251,878, Simendinger et al., filed Jun. 1, 1994.

U.S. application No. 08/255,584, Chandler et al., filed Jun. 8, 1994.

U.S. application No. 08/481,028, Simendinger et al., filed Jun. 7, 1995.

U.S. application No. 08/482,064, Munch et al., filed Jun. 7, 1995.

*Primary Examiner*—Teresa J. Walberg

*Assistant Examiner*—Karl Easthom

*Attorney, Agent, or Firm*—Marquerite E. Gerstner; Herbert G. Burkard

[57] ABSTRACT

An electrical device in which a first resistive element which is composed of a first electrically non-linear composition is in electrical contact, and preferably in physical and electrical contact, with a second resistive element which is composed of a second composition which has a resistivity of less than 100 ohm-cm. The first composition has a resistivity of more than $10^9$ ohm-cm and contains a first particulate filler. The second composition contains a second particulate filler which (a) is magnetic and electrically conductive, and (b) is aligned in discrete regions in the second polymeric component. The device also contains first and second electrodes which are positioned so that current can flow between the electrodes through the first and second resistive elements. Devices of the invention have relatively low breakdown voltages and can survive high energy fault conditions.

17 Claims, 5 Drawing Sheets

U.S. PATENT DOCUMENTS

| | | | |
|---|---|---|---|
| 3,858,077 | 12/1974 | Bazarian | 313/217 |
| 3,896,343 | 7/1975 | Baker et al. | 317/61 |
| 3,898,533 | 8/1975 | Scudner, Jr. | 317/61 |
| 3,950,604 | 4/1976 | Penneck | 174/68 A |
| 3,987,343 | 10/1976 | Cunningham et al. | 317/61.5 |
| 3,990,762 | 11/1976 | Lemesle | 339/97 R |
| 4,034,326 | 7/1977 | Hill et al. | 337/34 |
| 4,037,905 | 7/1977 | Lucas | 339/98 |
| 4,056,840 | 11/1977 | Lundsgaard et al. | 361/124 |
| 4,062,054 | 12/1977 | Simokat | 361/119 |
| 4,068,277 | 1/1978 | Simokat | 361/55 |
| 4,145,103 | 3/1979 | Knowles | 339/99 R |
| 4,150,414 | 4/1979 | Pagliuca | 361/124 |
| 4,156,264 | 5/1979 | Hoover | 328/118 |
| 4,157,208 | 6/1979 | Roberts et al. | 339/98 |
| 4,158,869 | 6/1979 | Gilberts | 361/118 |
| 4,159,159 | 6/1979 | Kaucic et al. | 339/198 H |
| 4,212,047 | 7/1980 | Napiorkowski | 361/124 |
| 4,212,507 | 7/1980 | Bunnell | 339/18 B |
| 4,266,108 | 5/1981 | Anderson et al. | 219/10.55 E |
| 4,275,432 | 6/1981 | Napiorkowski | 361/124 |
| 4,303,959 | 12/1981 | Roberts et al. | 361/124 |
| 4,319,300 | 3/1982 | Napiorkowski et al. | 361/119 |
| 4,320,435 | 3/1982 | Jones | 361/119 |
| 4,321,649 | 3/1982 | Gilberts | 361/119 |
| 4,333,861 | 6/1982 | Aoki et al. | 252/518 |
| 4,355,072 | 10/1982 | Mateika et al. | 428/336 |
| 4,359,414 | 11/1982 | Mastrangelo | 523/200 |
| 4,379,605 | 4/1983 | Hoffman | 339/14 R |
| 4,383,237 | 5/1983 | Eda et al. | 338/21 |
| 4,393,433 | 7/1983 | Anderson et al. | 361/119 |
| 4,394,704 | 7/1983 | Jones | 361/119 |
| 4,396,970 | 8/1983 | Scudner, Jr. | 361/127 |
| 4,424,546 | 1/1984 | Smith | 361/119 |
| 4,430,255 | 2/1984 | Yan | 252/512 |
| 4,488,008 | 12/1984 | Dellinger et al. | 179/81 R |
| 4,500,158 | 2/1985 | Dola | 339/122 R |
| 4,520,294 | 5/1985 | Iida et al. | 315/50 |
| 4,541,679 | 9/1985 | Fiedler et al. | 339/97 |
| 4,541,898 | 9/1985 | Mase et al. | 205/794.5 |
| 4,548,459 | 10/1985 | Mosser, III | 339/97 P |
| 4,559,167 | 12/1985 | Julke et al. | 252/518 |
| 4,588,238 | 5/1986 | Mickelson et al. | 339/91 R |
| 4,597,623 | 7/1986 | Krumreich | 339/97 P |
| 4,600,261 | 7/1986 | Debbaut | 339/116 C |
| 4,600,804 | 7/1986 | Howard | 174/84 C |
| 4,634,207 | 1/1987 | Debbaut | 339/116 C |
| 4,635,297 | 1/1987 | Polischuk | 445/217 |
| 4,645,285 | 2/1987 | Cozzens et al. | 339/96 |
| 4,647,121 | 3/1987 | Dolansky et al. | 339/14 R |
| 4,647,896 | 3/1987 | Ratell | 338/22 R |
| 4,662,692 | 5/1987 | Uken et al. | 339/96 |
| 4,680,665 | 7/1987 | Bonnesen | 361/120 |
| 4,689,475 | 8/1987 | Kleiner et al. | 219/553 |
| 4,690,831 | 9/1987 | Uken et al. | 427/44 |
| 4,707,762 | 11/1987 | Yapoujian | 361/124 |
| 4,716,183 | 12/1987 | Gamarra et al. | 522/80 |
| 4,726,991 | 2/1988 | Hyatt et al. | 428/329 |
| 4,729,059 | 3/1988 | Wang | 361/356 |
| 4,729,064 | 3/1988 | Singer, Jr. | 361/426 |
| 4,741,032 | 4/1988 | Hampton | 379/399 |
| 4,741,480 | 5/1988 | Despault et al. | 439/412 |
| 4,764,125 | 8/1988 | Debortoli | 439/403 |
| 4,764,300 | 8/1988 | Hibst et al. | 252/62.58 |
| 4,777,063 | 10/1988 | Dubrow et al. | 427/44 |
| 4,800,253 | 1/1989 | Kleiner et al. | 219/553 |
| 4,800,588 | 1/1989 | Poster, Jr. | 379/412 |
| 4,822,298 | 4/1989 | Gerke et al. | 439/402 |
| 4,822,306 | 4/1989 | Klaiber | 439/709 |
| 4,841,259 | 6/1989 | Mayer | 333/17.2 |
| 4,846,720 | 7/1989 | Song | 439/407 |
| 4,846,721 | 7/1989 | Debruycker et al. | 439/411 |
| 4,851,946 | 7/1989 | Igarashi et al. | 361/124 |
| 4,852,646 | 8/1989 | Dittmer et al. | 165/185 |
| 4,864,725 | 9/1989 | Debbaut | 29/871 |
| 4,865,905 | 9/1989 | Uken et al. | 428/220 |
| 4,866,561 | 9/1989 | Dorival | 361/119 |
| 4,910,489 | 3/1990 | Neuwirth et al. | 337/32 |
| 4,910,770 | 3/1990 | Collins et al. | 379/399 |
| 4,912,592 | 3/1990 | Flindall et al. | 361/120 |
| 4,919,544 | 4/1990 | Graham | 379/399 |
| 4,932,051 | 6/1990 | Karan et al. | 379/399 |
| 4,945,559 | 7/1990 | Collins e tal. | 379/399 |
| 4,949,376 | 8/1990 | Nieves et al. | 379/399 |
| 4,952,169 | 8/1990 | Hayes, Sr. | 439/403 |
| 4,954,098 | 9/1990 | Hollingsworth et al. | 439/404 |
| 4,977,357 | 12/1990 | Shrier | 338/21 |
| 4,979,209 | 12/1990 | Collins et al. | 379/399 |
| 4,984,125 | 1/1991 | Uwano | 361/124 |
| 4,992,333 | 2/1991 | Hyatt | 428/402 |
| 4,993,966 | 2/1991 | Levy | 439/411 |
| 5,021,004 | 6/1991 | Heiney | 439/317 |
| 5,027,100 | 6/1991 | Neuwirth et al. | 337/32 |
| 5,029,302 | 7/1991 | Masghati et al. | 337/32 |
| 5,050,033 | 9/1991 | Pagliuca | 361/119 |
| 5,068,634 | 11/1991 | Shrier | 338/21 |
| 5,069,637 | 12/1991 | Baubles | 439/412 |
| 5,074,804 | 12/1991 | Pandand et al. | 439/395 |
| 5,079,300 | 1/1992 | Dubrow et al. | 525/106 |
| 5,080,606 | 1/1992 | Burkard | 439/403 |
| 5,085,597 | 2/1992 | Story et al. | 439/521 |
| 5,086,368 | 2/1992 | Gerke et al. | 361/118 |
| 5,090,917 | 2/1992 | Noorily et al. | 439/395 |
| 5,104,930 | 4/1992 | Rinde et al. | 524/871 |
| 5,139,440 | 8/1992 | Volk et al. | 439/413 |
| 5,142,264 | 8/1992 | Radford et al. | 338/21 |
| 5,149,278 | 9/1992 | Waas et al. | 439/412 |
| 5,149,736 | 9/1992 | Gamarra | 524/490 |
| 5,178,797 | 1/1993 | Evans | 252/511 |
| 5,190,700 | 3/1993 | Watanabe et al. | 252/609 |
| 5,195,015 | 3/1993 | Kaczmarek | 361/119 |
| 5,260,848 | 11/1993 | Childers | 361/127 |
| 5,294,374 | 3/1994 | Martinez et al. | 252/518 |
| 5,309,313 | 5/1994 | Yaworski et al. | 361/127 |
| 5,313,184 | 5/1994 | Greuter et al. | 338/21 |
| 5,340,641 | 8/1994 | Xu | 428/209 |
| 5,378,407 | 1/1995 | Chandler et al. | 252/513 |
| 5,382,384 | 1/1995 | Biagrie et al. | 252/513 |
| 5,414,403 | 5/1995 | Greuter et al. | 338/22 R |
| 5,451,919 | 9/1995 | Chu et al. | 338/22 R |
| 5,557,250 | 9/1996 | Debbaut et al. | 338/21 |

LAMINAR NON-LINEAR DEVICE WITH MAGNETICALLY ALIGNED PARTICLES

BACKGROUND OF THE INVENTION

1. Field of the Invention

This invention relates to electrical devices comprising electrically non-linear compositions.

2. Introduction to the Invention

Devices comprising electrically non-linear compositions are known for protecting electrical equipment and circuitry. The compositions used in such devices often exhibit non-linear electrical resistivity, decreasing in resistivity from an insulating state, i.e. more than $10^6$ ohm-cm, to a conducting state when exposed to a voltage that exceeds a threshold value. This value is known as the breakdown voltage. Compositions exhibiting non-linear electrical behavior are disclosed in U.S. Pat. No. 4,977,357 (Shrier) and U.S. Pat. No. 5,294,374 (Martinez et al), and in co-pending, commonly assigned U.S. patent applications Ser. No. 08/046,059 (Debbaut et al, filed Apr. 10, 1993), now U.S. Pat. No. 5,557,250, issued Sep. 17, 1996, application Ser. No. 08/251,878 (Simendinger et al, filed Jun. 1, 1994), and application Ser. No. 08/481,028 (Simendinger et al, filed Jun. 7, 1995), the disclosures of which are incorporated herein by reference.

Electrical devices prepared from these conventional compositions have been described. See, for example, U.S. patent application Ser. No. 08/251,878 which discloses an electrically non-linear resistive element suitable for repeated use as the secondary protection in a telecommunications gas tube apparatus. That resistive element comprises a composition in which a particulate filler such as aluminum is dispersed in a polymeric matrix. The composition has an initial resistivity $\rho_i$ at 25° C. of at least $10^9$ ohm-cm and, even after exposure to a standard impulse breakdown test in which a high energy impulse is applied across the element five times, has a final resistivity $\rho_f$ at 25° C. of at least $10^9$ ohm-cm. However, such devices, when exposed to a high energy fault condition, will short out and are thus not reusable. Furthermore, the scatter in the breakdown voltage on successive test events is relatively broad.

U.S. patent application Ser. No. 08/481,028 discloses a device which is designed to protect electrical components as a primary protection device rather than as a secondary protection device. In this device, a resistive element is positioned between two electrodes and is composed of a polymeric component in which a first magnetic, electrically conductive particulate filler and a second magnetic particulate filler with a resistivity of at least $1\times10^4$ ohm-cm are aligned in discrete regions extending from the first to the second electrode. In order to increase the electrical stability of the device, a conductive intermediate layer, e.g. a conductive adhesive or a conductive polymer layer, is positioned between the resistive element and an electrode. This intermediate layer has a resistivity substantially lower than that of the resistive element. While such devices have improved stability over conventional devices, they require relatively high breakdown voltages, exhibit relatively high scatter, and are not able to withstand the high power conditions necessary for some applications.

SUMMARY OF THE INVENTION

In order to provide maximum protection, it is preferred that the breakdown voltage of the device be relatively low, e.g. less than 500 volts, so that the device will operate under fault conditions in which the applied voltage is relatively low. It is also preferred that the breakdown voltage be relatively constant after multiple fault conditions. In order to effectively and repeatedly provide protection, it is preferred that the device have a relatively stable insulation resistance, i.e. an insulation resistance of more than $1\times10^9$ ohms after exposure to a breakdown voltage is usually required. Furthermore, it is desirable that the device have the capability to withstand high energy fault conditions such as a lightning-type surge, i.e. a 10×1000 microsecond current waveform and a peak current of 60 A. We have now found that a device which comprises at least two layers of different materials can exhibit each of these features. In a first aspect this invention provides an electrical device which comprises (A) a first resistive element which is composed of a first electrically non-linear composition which (i) has a resistivity at 25° C. of more than $10^8$ ohm-cm and (ii) comprises
  (1) a first polymeric component, and
  (2) a first particulate filler dispersed in the first polymeric component;

(B) a second resistive element which (i) is in electrical contact, and preferably in physical and electrical contact, with the first element, and (ii) is composed of a second composition which has a resistivity of less than 100 ohm-cm and which comprises
  (1) a second polymeric component, and
  (2) a second particulate filler which (a) is magnetic and electrically conductive, and (b) is aligned in discrete regions in the second polymeric component; and (C) first and second electrodes which are positioned so that current can flow between the electrodes through the first element and the second element.

In a second aspect, the invention provides an electrical device which comprises (A) a first resistive element which is composed of a first electrically non-linear composition which (i) has a resistivity at 25° C. of more than $10^8$ ohm-cm and (ii) comprises
  (1) a first polymeric component which is a gel,
  (2) a first particulate filler dispersed in the first polymeric component which is a conductive filler or a semiconductive filler, and
  (3) a third particulate filler dispersed in the first polymeric component which is an arc suppressant, an oxidizing agent, or a surge initiator;

(B) a second resistive element which (i) is in physical and electrical contact with the first element, (ii) has a resistance at 25° C. of less than 100 ohms, and (iii) is composed of a second composition which has a resistivity at 25° C. of at most 100 ohm-cm and which comprises
  (1) a second polymeric component which is a gel,
  (2) a second particulate filler which (a) is magnetic and electrically conductive, and (b) is aligned in discrete regions in the second polymeric component, and
  (3) a fourth particulate filler dispersed in the second polymeric component which is an arc suppressant, an oxidizing agent, or a surge initiator; and (C) first and second electrodes which are positioned so that current can flow between the electrodes through the first element and the second element, said device having a breakdown voltage when measured at 60 A in a Standard Impulse Breakdown Test of less than 500 volts.

BRIEF DESCRIPTION OF THE DRAWINGS

The invention is illustrated by the drawings in which.

DETAILED DESCRIPTION OF THE INVENTION

Figure 1:
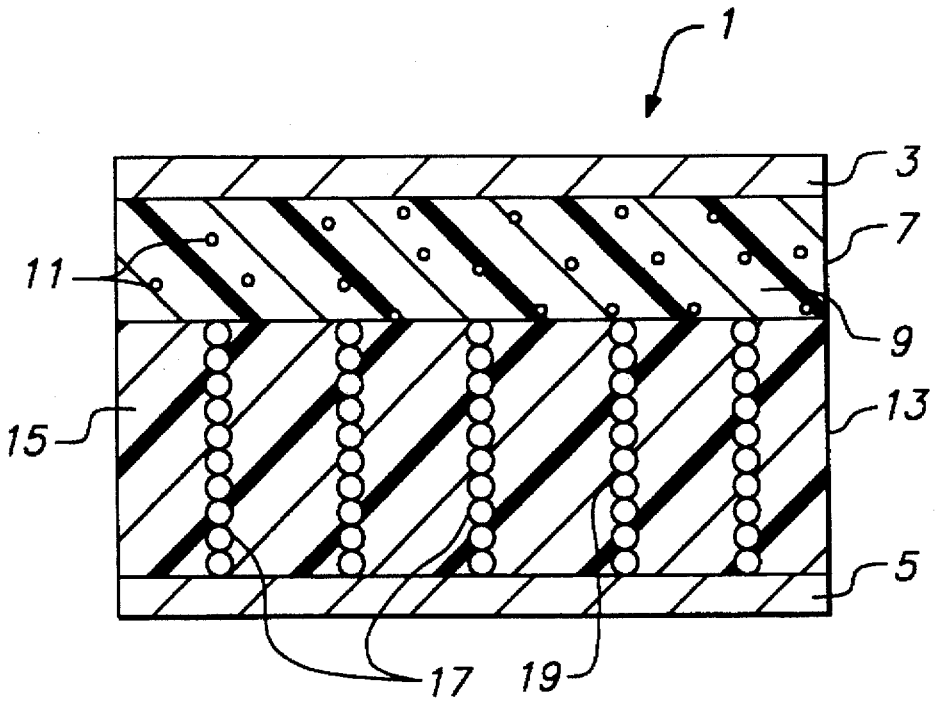
FIG. 1 is a schematic cross-sectional view of an electrical device according to the first aspect of the invention.

The electrical device of the invention comprises at least two resistive elements which, in the preferred embodiment, are in physical and electrical contact with each other. In this specification, the term "electrical contact" means having electrical continuity and includes configurations in which there may not be direct physical contact. The first resistive element is composed of a first composition which exhibits electrically non-linear behavior. In this specification the term "non-linear" means that the composition is substantially electrically non-conductive, i.e. has a resistivity of more than $10^6$ ohm-cm, and preferably more than $10^8$ ohm-cm, when an applied voltage is less than the impulse breakdown voltage, but then becomes electrically conductive, i.e. has a resistivity of substantially less than $10^6$ ohm-cm, when the applied voltage is equal to or greater than the impulse breakdown voltage. For many applications, it is preferred that the composition have a resistivity in the "nonconducting" state of more than $10^8$ ohm-cm, particularly more than $10^9$ ohm-cm, especially more than $10^{10}$ ohm-cm, and a resistivity in the "conducting" state of less than $10^3$ ohm-cm.

The second resistive element is composed of a second composition which, when cured, is electrically conductive, i.e. has a resistivity of less than $10^5$ ohm-cm, preferably less than $10^3$ ohm-cm, particularly less than 100 ohm-cm, more particularly less than 10 ohm-cm, especially less than 1 ohm-cm, most especially less than 0.5 ohm-cm. The second composition may exhibit positive temperature coefficient (PTC) behavior, i.e. an increase in resistivity over a relatively narrow temperature range.

The first composition comprises a first polymeric component in which is dispersed a first particulate filler and an optional third particulate filler. The second composition comprises a second polymeric component which contains a second particulate filler and an optional fourth particulate filler. The first and second polymeric components may be the same or different and may be any appropriate polymer, e.g. a thermoplastic material such as a polyolefin, a fluoropolymer, a polyamide, a polycarbonate, or a polyester; a thermosetting material such as an epoxy; an elastomer (including silicone elastomers, acrylates, polyurethanes, polyesters, and liquid ethylene/propylene/diene monomers); a grease; or a gel. It is preferred that both the first and the second polymeric components be a curable polymer, i.e. one that undergoes a physical and/or chemical change on exposure to an appropriate curing condition, e.g. heat, light, radiation (by means of an electron beam or gamma irradiation such as a $Co^{60}$ source), microwave, a chemical component, or a temperature change.

For many applications it is preferred that the first and/or the second polymeric component comprise a polymeric gel, i.e. a substantially dilute crosslinked solution which exhibits no flow when in the steady-state. The crosslinks, which provide a continuous network structure, may be the result of physical or chemical bonds, crystallites or other junctions, and must remain intact under the use conditions of the gel. Most gels comprise a fluid-extended polymer in which a fluid, e.g. an oil, fills the interstices of the network. Suitable gels include those comprising silicone, e.g. a polyorganosiloxane system, polyurethane, polyurea, styrene-butadiene copolymers, styrene-isoprene copolymers, styrene-(ethylene/propylene)-styrene (SEPS) block copolymers (available under the tradename Septon™ by Kuraray), styrene-(ethylene-propylene/ethylene-butylene)-styrene block copolymers (available under the tradename Septon™ by Kuraray), and/or styrene-(ethylene/butylene)-styrene (SEBS) block copolymers (available under the tradename Kraton™ by Shell Oil Co.). Suitable extender fluids include mineral oil, vegetable oil, paraffinic oil, silicone oil, plasticizer such as trimellitate, or a mixture of these, generally in an amount of 30 to 90% by volume of the total weight of the gel without filler. The gel may be a thermosetting gel, e.g. silicone gel, in which the crosslinks are formed through the use of multifunctional crosslinking agents, or a thermoplastic gel, in which microphase separation of domains serves as junction points. Disclosures of gels which may be suitable as the first and/or the second polymeric component in the composition are found in U.S. Pat. No. 4,600,261 (Debbaut), U.S. Pat. No. 4,690,831 (Uken et al), U.S. Pat. No. 4,716,183 (Gamarra et al), U.S. Pat. No. 4,777,063 (Dubrow et al), U.S. Pat. No. 4,864,725 (Debbaut et al), U.S. Pat. No. 4,865,905 (Uken et al), U.S. Pat. No. 5,079,300 (Dubrow et al), U.S. Pat. No. 5,104,930 (Rinde et al), and U.S. Pat. No. 5,149,736 (Gamarra); and in International Patent Publication Nos. WO86/01634 (Toy et al), WO88/00603 (Francis et al), WO90/05166 (Sutherland), WO91/05014 (Sutherland), and WO93/23472 (Hammond et al). The disclosure of each of these patents and publications is incorporated herein by reference.

The first polymeric component generally comprises 30 to 99%, preferably 30 to 95%, particularly 35 to 90%, especially 40 to 85% by volume of the total first composition. The second polymeric component generally comprises 50 to 99.99%, preferably 55 to 99.9%, particularly 60 to 99.9%, especially 65 to 99.9%, e.g. 70 to 99%, by volume of the total second composition.

Dispersed in the first polymeric component is a first particulate filler which may be electrically conductive, nonconductive, or a mixture of two or more types of fillers as long as the resulting composition has the appropriate electrical non-linearity. In this specification the term "electrically conductive" is used to mean a filler which is conductive or semiconductive and which has a resistivity of less than $10^2$ ohm-cm and is preferably much lower, i.e. less than 1 ohm-cm, particularly less than $10^{-1}$ ohm-cm, especially less than $10^{-3}$ ohm-cm. It is generally preferred that the filler be conductive or semiconductive. Conductive fillers generally have a resistivity of at most $10^{-3}$ ohm-cm; semiconductive fillers generally have a resistivity of at most $10^2$ ohm-cm, although their resistivity is a function of any dopant material, as well as temperature and other factors and can be substantially higher than $10^2$ ohm-cm. Suitable fillers include metal powders, e.g. aluminum, nickel, silver, silver-coated nickel, platinum, copper, tantalum, tungsten, gold, and cobalt; metal oxide powders, e.g. iron oxide, doped iron oxide, doped titanium dioxide, and doped zinc oxide; metal carbide powders, e.g. silicon carbide, titanium carbide, and tantalum carbide; metal nitride powders; metal boride powders; carbon black or graphite; and alloys, e.g. bronze and brass. It is also possible to use glass or ceramic particles, e.g. spheres, coated with any conductive material. Particularly preferred as fillers are aluminum, iron oxide ($Fe_3O_4$), iron oxide doped with titanium dioxide, silicon carbide, and silver-coated nickel. If the first polymeric component is a gel, it is important that the selected filler not interfere with the crosslinking of the gel, i.e. not "poison" it. The first filler is generally present in an amount of 1 to 70%, preferably 5 to 70%, particularly 10 to 65%, especially 15 to 60% by volume of the total first composition.

The volume loading, shape, and size of the filler affect the non-linear electrical properties of the first composition, in part because of the spacing between the particles. Any shape particle may be used, e.g. spherical, flake, fiber, or rod, although particles having a substantially spherical shape are preferred. Useful first compositions can be prepared with particles having an average size of 0.010 to 100 microns, preferably 0.1 to 75 microns, particularly 0.5 to 50 microns, especially 1 to 20 microns. A mixture of different size, shape, and/or type particles may be used. The particles may be magnetic or nonmagnetic. Examples of compositions suitable for use in the first composition are found in U.S. patent application Ser. No. 08/251,878 (Simendinger et al), the disclosure of which is incorporated herein by reference.

The second composition comprises a second particulate filler which is present at 0.01 to 50%, preferably 0.1 to 45%, particularly 0.1 to 40%, especially 0.1 to 35%, e.g. 1 to 30%, by volume of the total second composition. The second filler is both electrically conductive and magnetic. The term "magnetic" is used in this specification to mean ferromagnetic, ferrimagnetic, and paramagnetic materials. The filler may be completely magnetic, e.g. a nickel sphere, it may comprise a non-magnetic core with a magnetic coating, e.g. a nickel-coated ceramic particle, or it may comprise a magnetic core with a non-magnetic coating, e.g. a silver-coated nickel particle. Suitable second fillers include nickel, iron, cobalt, ferric oxide, silver-coated nickel, silver-coated ferric oxide, or alloys of these materials. Any shape particle may be used, although approximately spherical particles are preferred.. In general, the primary particle size of the second filler is less than 300 microns, preferably less than 200 microns, particularly less than 150 microns, especially less than 100 microns, and is preferably in the range of 0.05 to 40 microns, particularly 1 to 10 microns. Because processing techniques, e.g. coating the primary particle, may result in agglomeration, it is possible that the second filler, as mixed into the second polymeric component, may have an agglomerate size of as much as 300 microns. For some applications, a mixture of different particle sizes and/or shapes and/or materials may be desirable.

The second particulate filler is aligned in discrete regions or domains of the second polymeric component, e.g. as a column that extends through the second polymeric component from one side to the other, in particular from one side of the second resistive element (generally in contact with an electrode) to the first resistive element. Such domains can be formed in the presence of a magnetic field that causes the magnetic first and second filler particles to align. When such alignment occurs during curing of the polymeric component, the alignment is maintained in the cured polymeric component. The resulting alignment provides anisotropic conductivity. Any type of magnetic field that is capable of supplying a field strength sufficient to align the particles may be used. A conventional magnet of any type, e.g. ceramic or rare earth, may be used, although for ease in manufacture, it may be preferred to use an electromagnet with suitably formed coils to generate the desired magnetic field. It is often preferred that the uncured polymeric component be positioned between two magnets during the curing process, although for some applications, e.g. a particular device geometry, or the need to cure by means of ultraviolet light, it can be sufficient that there be only one magnet that is positioned on one side of the polymeric component. The polymeric component is generally separated from direct contact with the magnets by means of an electrically insulating spacing layer, e.g. a polycarbonate, polytetrafluoroethylene, or silicone sheet, or by means of first and second electrodes. It is important that the amount of second filler present produces a resistive element which has conductivity only through the thickness of the resistive element, not between adjacent columns, thus providing anisotropic conductivity.

In order to improve the electrical performance of devices of the invention, it is preferred that the first composition and the second composition comprise at least one additional particulate filler, i.e. a third particulate filler for the first composition and a fourth particulate filler for the second composition. This additional particulate filler may be the same for both the first and second compositions, or it may be different. In addition, the additional particulate filler may comprise a mixture of two or more different materials, which may be the same or different, and in the same concentration or different concentrations, for the first and second compositions. The third particulate filler is present in an amount of 0 to 60%, preferably 5 to 50%, particularly 10 to 40% by total volume of the first composition. The fourth particulate filler is present in an amount of 0 to 60%, preferably 5 to 50%, particularly 10 to 40% by total volume of the second composition. Particularly preferred for use as the third or fourth particulate fillers are arc suppressing agents or flame retardants, and oxidizing agents. Compositions with particularly good performance under high current conditions, e.g. 250 A, have been prepared when the third and/or the fourth particulate filler comprises a mixture of (i) an arc suppressing agent or flame retardant, and (ii) an oxidizing agent. It is preferred that the oxidizing agent be present in an amount 0.1 to 1.0 times that of the arc suppressing agent or flame retardant. The oxidizing agent is generally present at 0 to 20%, preferably 5 to 15% by total volume of the first composition, and/or at 0 to 20%, preferably 5 to 15% by total volume of the second composition. Particularly good results are achieved when the oxidizing agent is coated onto the arc suppressing agent or flame retardant prior to mixing. Suitable arc suppressing agents and flame retardants include zinc borate, magnesium hydroxide, alumina trihydrate, aluminum phosphate, barium hydrogen phosphate, calcium phosphate (tribasic or dibasic), copper pyrophosphate, iron phosphate, lithium phosphate, magnesium phosphate, nickel phosphate, zinc phosphate, calcium oxalate, iron (II) oxalate, manganese oxalate, strontium oxalate, and aluminum trifluoride trihydrate. It is important that any decomposition products of the arc suppressing agent be electrically nonconductive. Suitable oxidizing agents include potassium permanganate, ammonium persulfate, magnesium perchlorate, manganese dioxide, bismuth subnitrate, magnesium dioxide, lead dioxide (also called lead peroxide), and barium dioxide. While we do not wish to be bound by any theory, it is believed that the presence of the arc suppressing agent or flame retardant, and the oxidizing agent controls the plasma chemistry of the plasma generated during an electrical discharge, and provides discharge products that are nonconductive.

For some applications, it is preferred that the third and/or fourth particulate fillers comprise a surge initiator. Surge initiators have a low decomposition temperature, e.g. 150° to 200° C., and act to decrease the breakdown voltage of the composition and provide more repeatable breakdown voltage values. Suitable surge initiators include oxalates, carbonates, or phosphates. The surge initiator may also act as an arc suppressant for some compositions. If present, the surge initiator generally comprises 5 to 30%, preferably 5 to 25% by total volume of the composition.

Both the first composition and the second composition may comprise additional components including antioxidants, radiation crosslinking agents (often referred to as prorads or crosslinking enhancers), stabilizers, dispersing agents, coupling agents, acid scavengers, or other components. These components generally comprise at most 10% by volume of the total composition in which they are present.

The first and second compositions may be prepared by any suitable means, e.g. melt-blending, solvent-blending, or intensive mixing. Because it is preferred that the first and second polymeric components have a relatively low viscosity, particularly prior to curing, the fillers can be mixed into the polymeric component by hand or by the use of a mechanical stirrer. Mixing is conducted until a uniform dispersion of the filler particles is achieved. The composition may be shaped by conventional methods including extrusion, calendaring, casting, and compression molding. If the polymeric component is a gel, the gel may be mixed with the fillers by stirring and the composition may be poured or cast onto a substrate or into a mold to be cured.

In order to accommodate the necessary loading of the particulate fillers, and to allow alignment of the fillers in the polymeric component, it is preferred that the first and second polymeric components, prior to any curing and without any filler, have a viscosity at room temperature of at most 200,000 cps, preferably at most 100,000 cps, particularly at most 10,000 cps, especially at most 5,000 cps, more especially at most 1,000 cps. This viscosity is generally measured by means of a Brookfield viscometer at the cure temperature, $T_c$, if the polymeric component is curable, or at the mixing temperature at which the particulate fillers are dispersed and subsequently aligned if the polymeric component is not curable.

The electrical device of the invention comprises at least one first resistive element which is preferably in electrical and physical contact with at least one second resistive element. It is preferred that the first and second elements be in direct physical and electrical contact with one another, but it is possible that only some part of the first and second elements is in direct physical contact, or that there is an intermediate layer, e.g. a metal sheet, between the two elements. While a single first resistive element and a single second resistive element can be used, it is also possible that two first resistive elements may be positioned on opposite sides of a second resistive element, or two second resistive elements may be positioned on opposite sides of a first resistive element. The direction of conductivity of the second resistive element is perpendicular to the plane of the first resistive element. Depending on the method of preparing the resistive elements, they may be of any thickness or geometry, although both the first and the second resistive elements are of generally laminar configuration. In a preferred configuration, the first resistive element has a thickness of 0.25 to 1.0 mm, while the second resistive element has a thickness of 1.0 to 2.0 mm. The first and second resistive elements may be attached by any suitable method, e.g. a physical attachment method such as a clamp, or an attachment resulting from physical or chemical bonds. In some cases, if the first and second compositions are curable, the first and second resistive elements may be cured in contact with one another, as long as it is possible to properly align the second particulate filler.

The electrical device comprises first and second electrodes which are positioned so that, when the device is connected to a source of electrical power, current can flow between the electrodes through the first and second resistive elements. Generally the first electrode is attached to the first resistive element, and the second electrode to the second resistive element, but if the device comprises a center first resistive element sandwiched between two second resistive elements, the first electrode may be positioned in contact with one second resistive element and the second electrode may be positioned in contact with the other second resistive element. Similarly, if the device comprises a center second resistive element between two first resistive elements, the first and second electrodes may be positioned in contact with the two first resistive elements. The type of electrode is dependent on the shape of the first and second elements, but is preferably laminar and in the form of a metal foil, metal mesh, or metallic ink layer. The first electrode has a first resistivity and the second electrode has a second resistivity, both of which are generally less than $1\times10^{-2}$ ohm-cm, preferably less than $1\times10^{-3}$ ohm-cm, particularly less than $1\times10^{-4}$ ohm-cm. Particularly suitable metal foil electrodes comprise microrough surfaces, e.g. electrodeposited layers of nickel or copper, and are disclosed in U.S. Pat. No. 4,689,475 (Matthiesen), U.S. Pat. No. 4,800,253 (Kleiner et al), and pending U.S. application Ser. No. 08/255,584 (Chandler et al, filed Jun. 8, 1994), now abandoned in favor of file wrapper continuation application Ser. No. 08/672,496, filed Jun. 28, 1996 the disclosure of each of which is incorporated herein by reference.

Depending on the type of the polymeric components and the electrodes, it may be desirable to cure the first and second compositions directly in contact with the electrodes. Alternatively, it is possible to cure the compositions partially or completely before attaching the electrodes to the cured compositions. The latter technique is especially appropriate for use with mesh or other foraminous electrode materials. In order to control the thickness of the first and second resistive elements, the uncured composition may be poured or otherwise positioned within a mold of specified thickness, and then cured. For some applications, improved electrical stability for the device may be achieved if at least one and preferably both of the electrodes is both electrically conductive and has at least some portion which is magnetic. Electrodes of this type include nickel, nickel-coated copper, and stainless steel. It is preferred that the entire surface of the electrode comprise the magnetic material. Similar electrodes and techniques may be used to prepare electrical devices as described in U.S. patent application Ser. No. 08/482,064 (Munch et al, filed Jun. 7, 1995), the disclosure of which is incorporated herein by reference.

The first and second polymeric components may be cured by any suitable means, including heat, light, microwave, electron beam, or gamma irradiation, and are often cured by using a combination of time and temperature suitable to substantially cure the polymeric components. The curing temperature $T_c$ may be at any temperature that allows substantial curing of the polymeric component, i.e. that cures the polymeric component to at least 70%, preferably at least 80%, particularly at least 90% of complete cure. When the curable polymeric component is a thermosetting resin which has a glass transition temperature $T_g$, it is preferred that the curing be conducted at a curing temperature $T_c$ which is greater than $T_g$. A catalyst, e.g. a platinum catalyst, may be added to initiate the cure and control the rate and/or uniformity of the cure. When the polymeric component is a gel, it is preferred that, when cured without any filler, the gel be relatively hard, i.e. have a Voland hardness of at least 100 grams, particularly at least 200 grams, especially at least 300 grams, e.g. 400 to 600 grams, in order to minimize disruption of the aligned particles when exposed to a high energy condition. In addition, it is preferred that the cured gel have stress relaxation of less than 25%, particularly less than 20%, especially less than 15%. The Voland hardness and stress relaxation are measured using a Voland-Stevens Texture Analyzer Model LFRA having a 1000 gram load cell, a 5 gram trigger, and a 0.25 inch (6.35 mm) ball probe, as described in U.S. Pat. No. 5,079,300 (Dubrow et al), the disclosure of which is incorporated herein by reference. To measure the hardness of a gel, a 20 ml glass scintillating vial containing 10 grams of gel is placed in the analyzer and the stainless steel ball probe is forced into the gel at a speed of 0.20 mm/second to a penetration distance of 4.0 mm. The Voland hardness value is the force in grams required to force the ball probe at that speed to penetrate or deform the surface of the gel the specified 4.0 mm. The Voland hardness of a particular gel may be directly correlated to the ASTM D217 cone penetration hardness using the procedure described in U.S. Pat. No. 4,852,646 (Dittmer et al), the disclosure of which is incorporated herein by reference.

The device of the invention is nonconductive, i.e. has an insulation resistance at 25° C. of more than $10^6$ ohms, preferably more than $10^8$ ohms, particularly more than $10^9$ ohms, especially more than $10^{10}$ ohms. The resistance of the second resistive element at 25° C., if measured on its own, not in contact with the first resistive element, is at most 1000 ohms, preferably at most 100 ohms, particularly at most 10 ohms, especially at most 1 ohm.

Electrical devices of the invention, when tested according to the Standard Impulse Breakdown Voltage Test, described below, preferably exhibit low breakdown voltage and maintain a high insulation resistance. Thus the breakdown voltage when tested at either 60 A or 250 A is at most 1000 volts, preferably at most 800 volts, particularly at most 700 volts, especially at most 600 volts, more especially at most 500 volts, e.g. 200 to 500 volts, and the final insulation resistance is at least $10^8$ ohms, as described above. It is preferred that the breakdown voltage be relatively stable over multiple cycles of the test, i.e. for any given cycle, the breakdown voltage varies from the average breakdown voltage for fifty cycles by ±70%, preferably by ±50%. When the composition of the invention is formed into a standard device as described below and exposed to a standard impulse breakdown test, the device has an initial breakdown voltage $V_{Si}$ and a final breakdown voltage $V_{Sf}$ which is from 0.70 $V_{Si}$ to 1.30 $V_{Si}$, preferably from 0.80 $V_{Si}$ to 1.20 $V_{Si}$, particularly from 0.85 $V_{Si}$ to 1.15 $V_{Si}$, especially from 0.90 $V_{Si}$ to 1.10 $V_{Si}$.

The first resistive element acts as a "switch" due to its non-linear nature, and controls the breakdown voltage of the device. However, if exposed to a very high energy pulse, e.g. a 10×1000 microsecond current waveform and a peak current of 300 Å, a small region in the first resistive element will short out if not in contact with the second resistive element. The second resistive element acts as a "point-plane" electrode. Each of the domains, generally in the form of columns, behaves as a microfuse which can be destroyed by the breakdown event. As a result, even if an affected portion of the first resistive element shorts out, a corresponding domain in the second resistive element will be destroyed, and will disconnect the shorted section of the first resistive element from the circuit. The device thus returns to a nonconductive state after the breakdown event. In addition, the electric field is concentrated at the tip of each domain or column, thus increasing the repeatability of the breakdown voltage on successive electrical events.

The invention is illustrated by the drawing in which FIG. 1 shows in cross-section electrical device 1. First electrode 3 is in contact with first resistive element 7, while second electrode 5 is in contact with second resistive element 13. First resistive element 7 is made of first polymeric component 9 which acts as a matrix in which is dispersed first particulate filler 11. Second resistive element 13 is made of second polymeric component 15 through which is dispersed in discrete domains aligned chains 17. Each chain 17 contains particles of second particulate filler 19.

The invention is illustrated by the following examples, each of which was tested using the Standard Impulse Breakdown Test.

Standard Device

Figure 2:
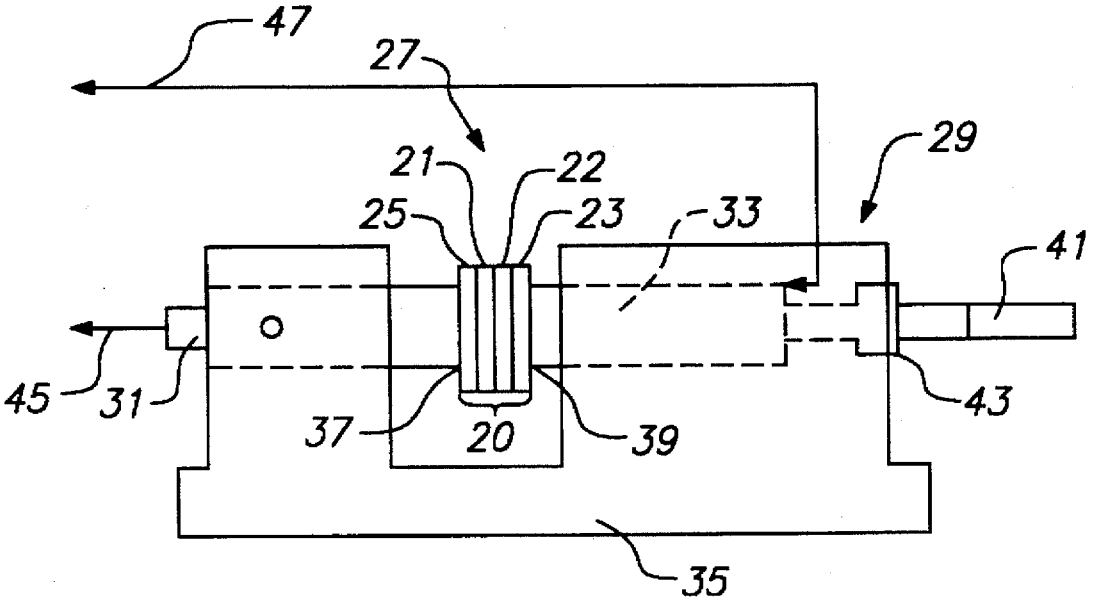
FIG. 2 is a cross-sectional view of a test fixture used to test a device of the invention.

Both the first composition and the second composition were prepared by mixing the designated components with a tongue depressor or mechanical stirrer to wet and disperse the particulate filler. Each composition was degassed in a vacuum oven for one minute. The second composition was poured onto a PTFE-coated release sheet, and covered with a second PTFE-coated release sheet separated from the first sheet by spacers having a thickness of about 1 mm. The outer surfaces of the release sheets were supported with rigid metal sheets and magnets with dimensions of 51×51×25 mm (2×2×1 inch) and having a pull force of 10 pounds (available from McMaster-Carr) were positioned over the metal sheets, sandwiching the composition. The second composition was then cured at 100° C. for 15 minutes. The top magnet, the top metal sheet, and the top release sheet were removed, additional spacers were added to give a thickness of 1.5 mm, and the first composition was poured onto the surface of the cured second composition. The top release sheet and the top metal sheet were replaced and a weight (which may be the top magnet) was placed on top of the top metal sheet. The arrangement was then cured at 100° C. for an additional 15 minutes to give a laminate of the first and second compositions. A disc 20 (as shown in FIG. 2) with a diameter of 15.9 mm and a thickness of 1.5 mm was cut from the cured laminate. The disc 20 consisted of a second resistive element 21 with a thickness of 1.0 mm from the cured second composition and a first resistive element 22 with a thickness of 0.5 mm from the first composition. Molybdenum electrodes 23, 25 having a diameter of 15.9 mm and a thickness of 0.25 mm (0.010 inch) were attached to the top and bottom surfaces of disc 20 to form a standard device 27.

Standard Impulse Breakdown Test

A standard device 27 was inserted into the test fixture 29 shown in FIG. 2. Two copper cylinders 31,33, approximately 19 mm (0.75 inch) in diameter, were mounted in a polycarbonate holder 35 such that the end faces 37,39 were parallel. One end 37 was fixed and immobile; the other end 39 was free to travel while still maintaining the parallel end-face geometry. Movement of cylinder 33 was controlled by barrel micrometer 41 mounted through mounting ring 43. Device 27 was mounted between cylinders 31,33, and micrometer 41 was adjusted until contact with zero compressive pressure was made to both sides of device 27. Pressure was then applied to device 27 by further moving cylinder 33 (via micrometer 41) to compress the sample 10% (generally 0.1 to 0.3 mm). Electrical leads 45,47 were connected from copper cylinders 31,33 to the testing equipment (not shown). Prior to testing, the insulation resistance $R_i$ for the device was measured at 25° C. with a biasing voltage of 50 volts using a Genrad 1864 Megaohm meter; the initial resistivity $\rho_i$ was calculated. Electrical connection was then made to a Keytek ECAT Series 100 Surge Generator using an E514A 10×1000 waveform generator. For each cycle a high energy impulse with a 10×1000 μs current waveform (i.e. a rise time to maximum current of 10 μs and a half-height at 1000 μs) and a peak current of 60 A was applied. The peak voltage measured across the device at breakdown, i.e. the voltage at which current begins to flow through the gel, was recorded as the impulse breakdown voltage. The final insulation resistance $R_f$ after fifty or one hundred cycles for the standard test was measured and the final resistivity ρf was calculated.

EXAMPLES 1 TO 15

The first and second resistive elements for Examples 1 to 15 were prepared from compositions using the formulations shown in Table I. In each case the silicone gel was formulated using 49.420% 1000 cs divinyl-terminated polydimethylsiloxane (available from United Chemical Technology (UCT)), 49.956% 50 cs silicone oil (polydimethylsiloxane fluid from UCT), 0.580% tetrakis(dimethyl siloxy silane) (UCT), 0.04% catalyst, and 0.004% inhibitor, all amounts by weight of the composition. The stoichiometry was adjusted for peak hardness, i.e. 600 grams using a Voland texture analyzer with a 7 mm stainless steel probe. The aluminum was a powder with an average particle size of 15 to 20 microns (−200 mesh) and a substantially spherical shape, available from Aldrich Chemicals. The nickel, available from Alfa Aesar, had a mesh size of −300 mesh and an average particle size of 3 to 10 microns. The arc suppressing agents, i.e. magnesium phosphate ($Mg_3(PO_4)_2.8H_2O$), zinc phosphate ($Zn_3(PO_4)_2.2H_2O$), calcium phosphate ($CaHPO_4.2H_2O$), iron oxalate ($FeC_2O_4.2H_2O$), and zinc borate ($3ZnO.2B_2O_3$), the oxidizing agents, i.e. bismuth subnitrate ($4BiNO_3(OH)_2.BiO(OH)$) and lead peroxide ($PbO_2$), and the surge initiators, i.e. calcium carbonate ($CaCO_3$, decomposition temperature 898° C.), manganese oxalate ($MnC_2O_4.2H_2O$, decomposition temperature 100° C.), and iron oxalate (which also acts as an arc suppressing agent, decomposition temperature 190° C.), were available from Alfa Aesar. Standard devices were prepared as above and tested using the Standard Impulse Breakdown Test for either 50 or 100 cycles, as indicated. (Testing for Example 11 was done at 100 A rather than 60 A.) In each case, except for comparative Examples 5 and 7, the devices had $R_i$ greater than $10^9$ ohms. For Examples 5 and 7 the value of $R_i$ was greater than $10^8$ ohms. The average breakdown voltage over the total number of test cycles and the standard deviation (i.e. a measure of the reproducibility of the breakdown voltage) are shown in Table I.

Figure 3:
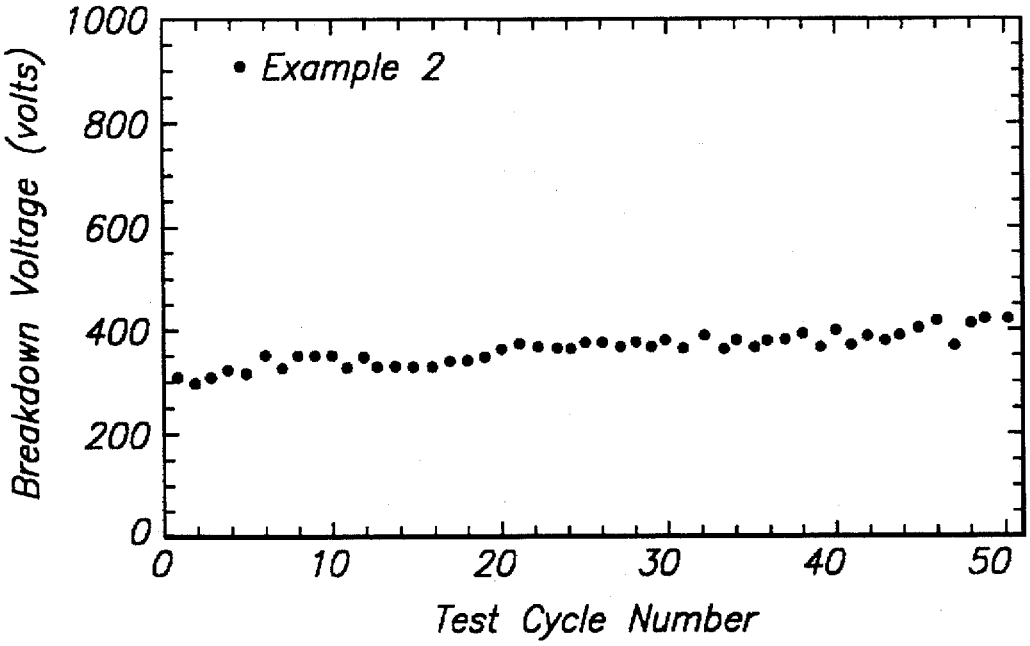
FIGS. 3, 4, 5*a* to 5*d*, and 6 are graphs of breakdown voltage as a function of test cycle number for devices of the invention.

Examples 1 to 4, which contained an arc suppressing agent, showed good low breakdown voltage (i.e. less than 1000 volts, and, for Examples 2 to 4, less than 400 volts), and good reproducibility. Each had an $R_f$ value of greater than $10^8$ ohms. The test results for Example 2 are shown in FIG. 3.

Figure 4:
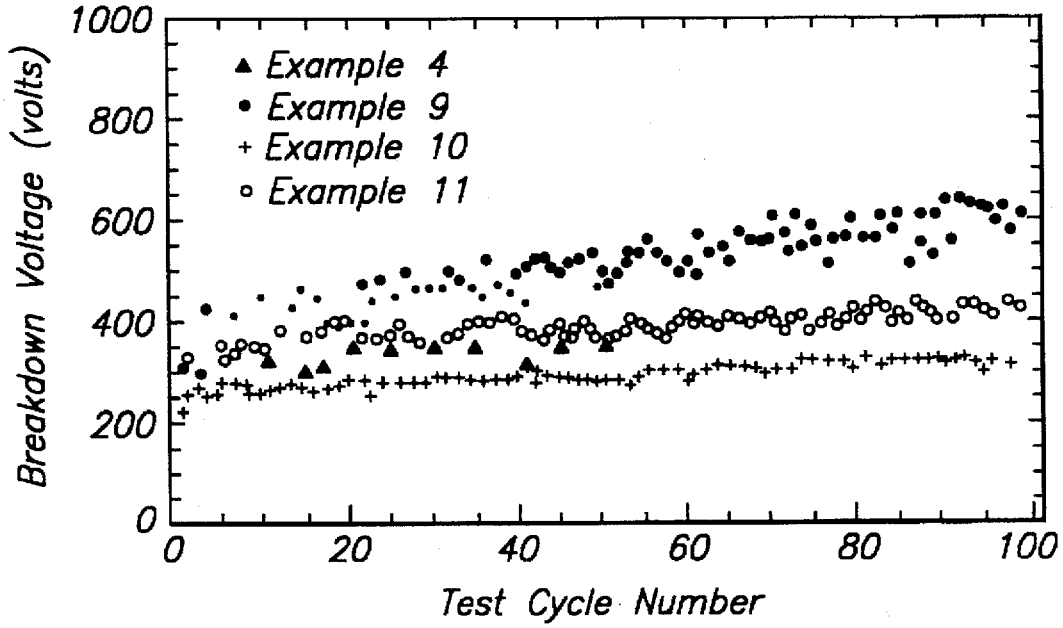
Figure 5A:
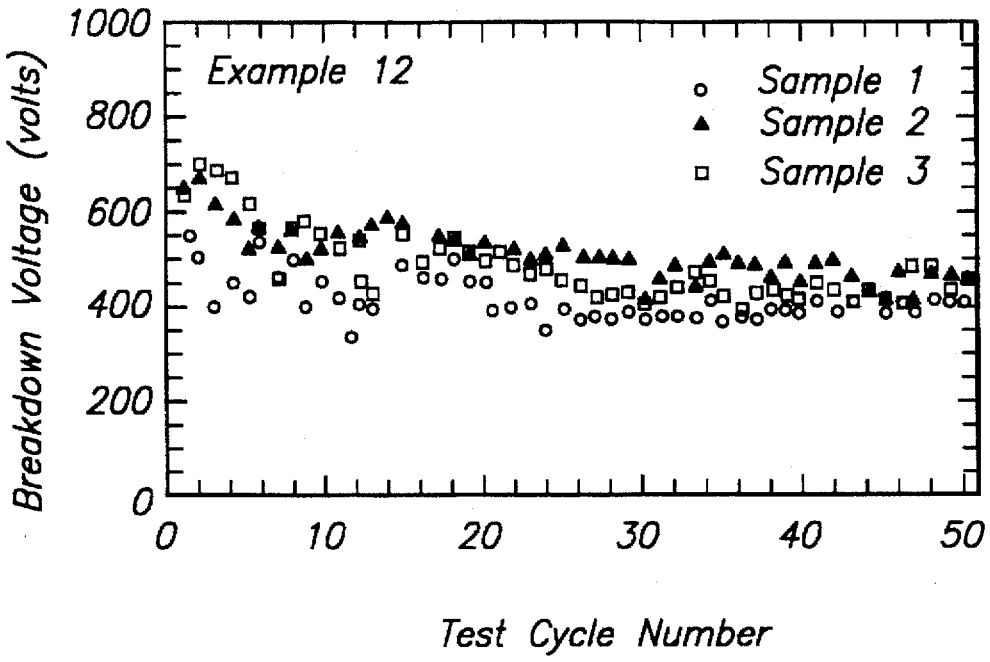
Figure 5B:
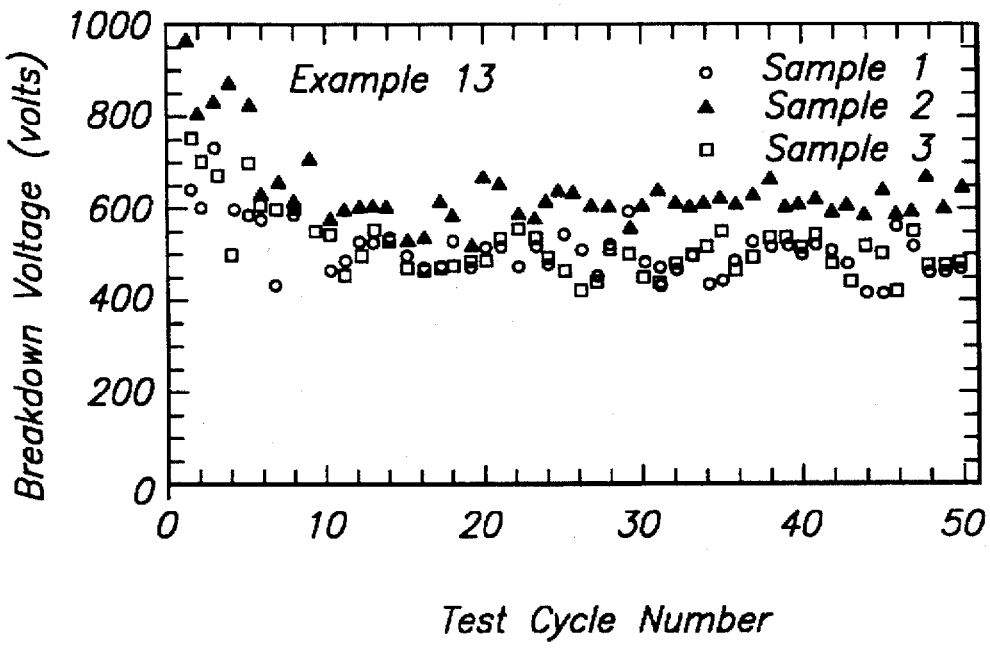
Figure 5C:
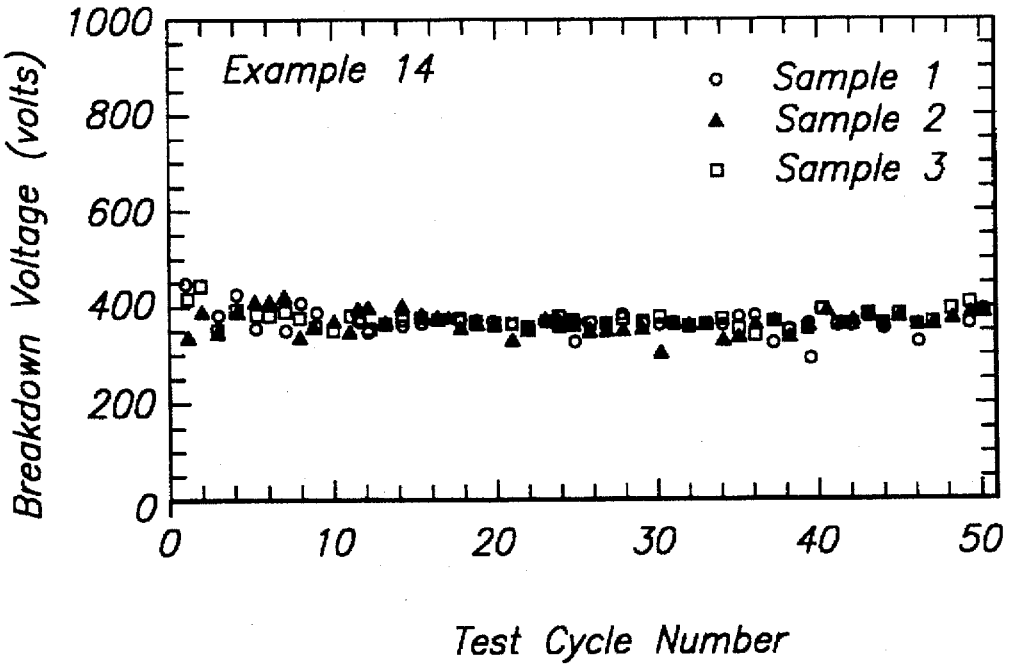
Figure 5D:
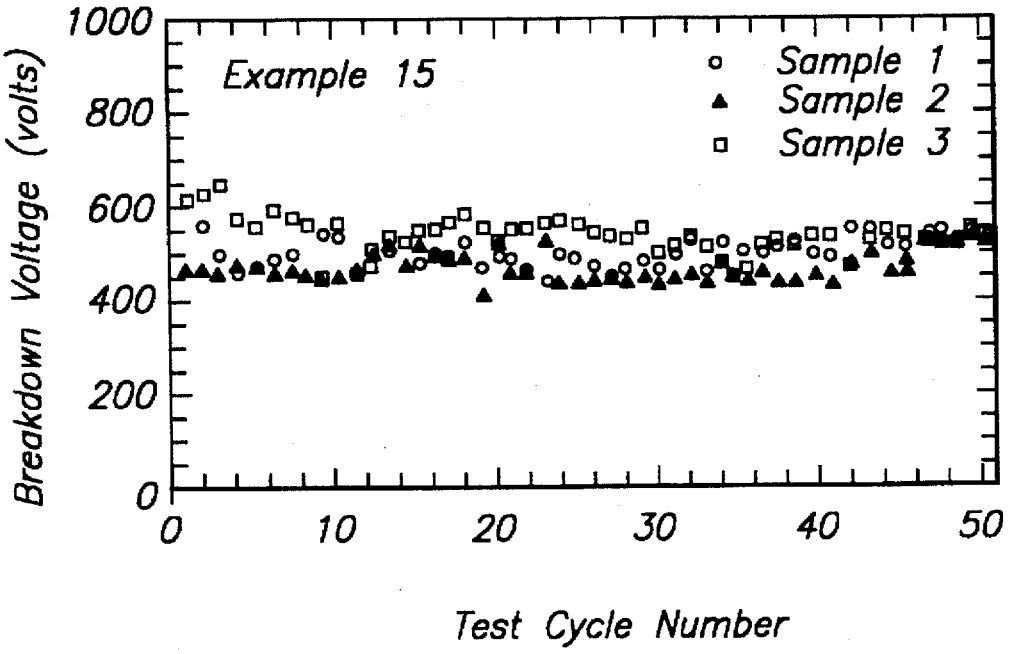

Examples 5 to 11 show the effects of the presence of both an arc suppressing agent and an oxidizing agent. Examples 5 and 7, which contained bismuth subnitrate in both the first and second resistive elements had an $R_f$ value of $1\times10^7$. When bismuth subnitrate, which becomes conductive when exposed to moisture, was used in the second resistive element only (Example 11), the device had an $R_f$ value of greater than $10^8$ ohms, and excellent reproducibility. Examples 12 to 15 show the effects of the presence of a surge initiator. Examples 14 and 15, which contained a surge initiator which had a low decomposition temperature, had low breakdown voltages and good reproducibility. Each of Examples 12 to 15 had an $R_f$ value of greater than $10^8$ ohms. The test results for Examples 4, 9, 10, and 11 are shown in FIG. 4. The test results for Examples 12 to 15 are shown in FIGS. 5*a* to 5*d*, respectively. In each of FIGS. 5*a* to 5*d* results are shown for three different samples of each type of device. The values reported in Table I are averages of the three samples for each example.

Monolayer devices which contained only a first resistive element made from a composition containing aluminum powder dispersed in a silicone, shown, for example in U.S. patent application Ser. No. 08/251,878, the disclosure of which is incorporated herein by reference, had a breakdown voltage of more than 1000 volts when tested using a 10×1000 microsecond waveform and a current of at most 1 A. They did not survive fifty cycles when tested at 60 A.

TABLE I (Loadings in Volume %)

| Example | 1 | 2 | 3 | 4 | 5* | 6 | 7* | 8 | 9 | 10 | 11 | 12 | 13 | 14 | 15 |
|---|---|---|---|---|---|---|---|---|---|---|---|---|---|---|---|
| First Element | | | | | | | | | | | | | | | |
| Aluminum | 30 | 30 | 30 | 30 | 30 | 30 | 30 | 30 | 30 | 30 | 30 | 30 | 30 | 30 | 30 |
| Magnesium phosphate | 20 | | | | | | | | | | | | | | |
| Zinc phosphate | | 20 | | | 10 | 10 | | | | | | | | | |
| Calcium phosphate | | | 20 | | | | 10 | 10 | | | | | | | |
| Iron oxalate | | | | 20 | | | | | 10 | 10 | 10 | | | 5 | |
| Bismuth subnitrate | | | | | 10 | | 10 | | 10 | | | | | | |
| Lead peroxide | | | | | | 10 | | 10 | | 10 | 10 | | | | |
| Zinc borate | | | | | | | | | | | | 15 | 10 | 10 | 10 |
| Calcium carbonate | | | | | | | | | | | | | 5 | | |
| Manganese oxalate | | | | | | | | | | | | | | | 5 |
| Silicone Gel | 50 | 50 | 50 | 50 | 50 | 50 | 50 | 50 | 50 | 50 | 50 | 55 | 55 | 55 | 55 |
| Second Element | | | | | | | | | | | | | | | |
| Nickel | 15 | 15 | 15 | 15 | 15 | 15 | 15 | 15 | 15 | 15 | 15 | 15 | 15 | 15 | 15 |
| Magnesium phosphate | 25 | | | | | | | | | | | | | | |
| Zinc phosphate | | 25 | | | 20 | 20 | | | | | | | | | |
| Calcium phosphate | | | 25 | | | | 20 | 20 | | | | | | | |
| Iron oxalate | | | | 25 | | | | | 20 | 20 | 20 | | | | |
| Bismuth subnitrate | | | | | 10 | | 10 | | 10 | | 10 | | | | |
| Lead peroxide | | | | | | 10 | | 10 | | 10 | | | | | |
| Zinc borate | | | | | | | | | | | | 30 | 30 | 30 | 30 |

TABLE I-continued

| | (Loadings in Volume %) | | | | | | | | | | | | | | |
|---|---|---|---|---|---|---|---|---|---|---|---|---|---|---|---|
| Example | 1 | 2 | 3 | 4 | 5* | 6 | 7* | 8 | 9 | 10 | 11 | 12 | 13 | 14 | 15 |
| Manganese oxalate | | | | | | | | | | | | | | | |
| Silicone Gel | 60 | 60 | 60 | 60 | 55 | 55 | 55 | 55 | 55 | 55 | 55 | 55 | 55 | 55 | |
| Breakdown voltage | | | | | | | | | | | | | | | |
| Average (volts) | 882 | 354 | 327 | 342 | 384 | 324 | 402 | 400 | 498 | 292 | 413 | 477 | 565 | 365 | 501 |
| Standard deviation | 156 | 29 | 26 | 16 | 45 | 54 | 50 | 53 | 77 | 19 | 17 | 58 | 69 | 27 | 30 |
| Test current (A) | 60 | 60 | 60 | 60 | 60 | 60 | 60 | 60 | 60 | 60 | 100 | 60 | 60 | 60 | 60 |
| Test cycles | 50 | 50 | 50 | 50 | 50 | 100 | 50 | 100 | 100 | 100 | 100 | 50 | 50 | 50 | 50 |

*Examples 5 and 7 are comparative examples.

EXAMPLE 16

Figure 6:
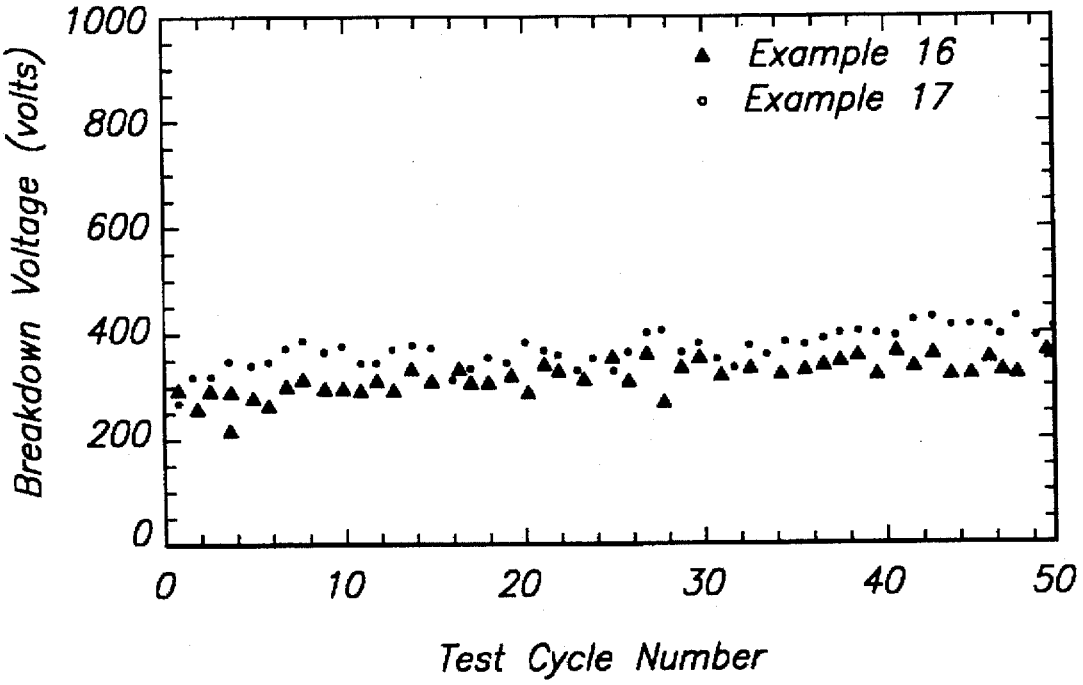

Following the procedure of Examples 1 to 15, a first composition was prepared containing 30% aluminum (−200 mesh), 10% zinc borate, 10% potassium permanganate, and 50% silicone gel (as in Example 1), and a second composition was prepared containing 11.25% nickel with a mesh size of −100 to +200 (available from Alfa Aesar, with an average particle size of about 100 microns), 3.75% nickel with a mesh size of −300, 20% zinc borate, 10% potassium permanganate, and 55% silicone gel (as in Example 1), all percentages by volume of each total composition. A Standard Device was prepared and tested 50 cycles at 60 A with a 10×1000 microsecond waveform. The average breakdown voltage was 318 volts, with a standard deviation of 27. Both $R_i$ and $R_f$ were $1\times10^{11}$ ohms. The test results are shown in FIG. 6.

EXAMPLE 17

A device was prepared as in Example 16 and tested 50 cycles at 220 A with a 10×1000 microsecond waveform. The average breakdown voltage was 365 volts, with a standard deviation of 32. Both $R_i$ and $R_f$ were $1\times10^{11}$ ohms. The test results are shown in FIG. 6.

What is claimed is:

1. An electrical device which comprises (A) a first laminar resistive element which (a) comprises a first surface and a second surface, and (b) is composed of a first electrically non-linear composition which (i) has a resistivity at 25° C. of more than $10^9$ ohm-cm and (ii) comprises (1) a first polymeric component, and (2) a first particulate filler dispersed in the first polymeric component;

(B) a second laminar resistive element which (a) comprises a third surface and a fourth surface, said third surface being in physical and electrical contact with the second surface of the first element, and (b) is composed of a second composition which (i) has a resistivity of less than 100 ohm-cm and (ii) comprises (1) a second polymeric component, and (2) a second particulate filler which (a) is magnetic and electrically conductive, and (b) is aligned in discrete regions in the second polymeric component in planes which are perpendicular to the first element;

(C) a first electrode which is in contact with the first surface; and (D) a second electrode which is in contact with the fourth surface so that current can flow between the electrodes through the first element and the second element.

2. A device according to claim 1 wherein at least one of the first component and the second component comprises a curable polymer.

3. A device according to claim 2 wherein the curable polymer comprises a gel.

4. A device according to claim 3 wherein the gel is a thermosetting gel or a thermoplastic gel.

5. A device according to claim 2 wherein the curable polymer comprises a thermosetting resin.

6. A device according to claim 5 wherein the thermosetting resin comprises a silicone elastomer, an acrylate, an epoxy, or a polyurethane.

7. A device according to claim 2 wherein the curable polymer has a viscosity of less than 200,000 cps when uncured.

8. A device according to claim 1 wherein the first filler comprises a conductive filler or a semiconductive filler.

9. A device according to claim 8 wherein the first filler is selected from the group consisting of metal powders, metal oxide powders, metal carbide powders, metal nitride powders, and metal boride powders.

10. A device according to claim 9 wherein the first filler comprises aluminum, nickel, silver, silver-coated nickel, platinum, copper, tantalum, tungsten, iron oxide, doped iron oxide, doped zinc oxide, silicon carbide, titanium carbide, tantalum carbide, glass spheres coated with a conductive material, or ceramic spheres coated with a conductive material.

11. A device according to claim 1 wherein the first filler comprises 1 to 70% by volume of the first composition.

12. A device according to claim 1 wherein the second filler comprises nickel, iron, cobalt, ferric oxide, silver-coated nickel, silver-coated ferric oxide, or alloys of these materials.

13. A device according to claim 12 wherein the first filler comprises 0.01 to 50% by volume of the second composition.

14. A device according to claim 1 which has a breakdown voltage when measured at 60 A in a Standard Impulse Breakdown Test of 200 to 1000 volts.

15. An electrical device which comprises (A) a first laminar resistive element which (a) comprises a first surface and a second surface, and (b) is composed of a first electrically non-linear composition which (i) has a resistivity at 25° C. of more than $10^9$ ohm/cm and (ii) comprises (1) a first polymeric component which is a gel, (2) a first particulate filler dispersed in the first polymeric component which is a conductive filler or a semiconductive filler, and (3) a third particulate filler dispersed in the first polymeric component which is an arc suppressant, an oxidizing agent, or a surge initiator;

(B) a second laminar resistive dement which (a) comprises a third surface and a fourth surface, said third surface being in physical and electrical contact with the second surface of the first element in physical and electrical contact with the second surface, and (b) (i) is in physical and electrical contact with the first element, (ii) has a resistance at 25° C. of less than 100 ohms, and (iii) is composed of a second composition which has a resistivity at 25° C. of at most 100 ohm-cm and which comprises (1) a second polymeric component which is a gel, (2) a second particulate filler which (a) is magnetic and electrically conductive, and (b) is aligned in discrete regions in the second polymeric component planes which are perpendicular to the first element, and (3) a fourth particulate filler dispersed in the second polymeric component which is an arc suppressant, an oxidizing agent, or a surge initiator; and (C) a first electrode which is in contact with the first surface; and (D) a second electrode which is in contact with the fourth surface so that current can flow between the electrodes through the first element and the second element, said device having a breakdown voltage when measured at 60 A in a Standard Impulse Breakdown Test of less than 1000 volts.

16. A device according to claim 15 wherein the first particulate filler comprises aluminum and the second particulate filler comprises nickel.

17. A device according to claim 15 wherein at least one of the first and second electrodes comprises a region composed of a material which is electrically conductive and magnetic.

* * * * *

UNITED STATES PATENT AND TRADEMARK OFFICE

CERTIFICATE OF CORRECTION

PATENT NO. : 5,742,223

INVENTOR(S) : Simendinger III, et al.

DATED : April 21, 1998

It is certified that error appears in the above-identified patent and that said Letters Patent is hereby corrected as shown below:

Cover Sheet (page 1), References Cited [56], U.S. Patent Documents, line 12, replace "Kron" by --Krone--.

Cover Sheet (page 2), References Cited [56], U.S. Patent Documents, right-hand column, line 59, as a new line before "5,414,403", insert --5,382,938, 01/1995, Hansson et al., 338/22R--.

Cover Sheet (page 1), Attorney, Agent or firm, Replace "Marquerite" by --Marguerite--.

Column 3, line 26, replace ""nonconducting"" by --"non-conducting"--.

Column 5, line 34, replace "preferred.." by --preferred.--.

Column 9, line 54, replace "300Å" by --300A--.

Claim 15, line 14, replace "dement" by --element--.

Claim 15, lines 17-18, delete "in physical and electrical contact with the second surface".

Claim 15, line 27, after "component", insert --in--.

Signed and Sealed this

Twentieth Day of October, 1998

*Attest:*

BRUCE LEHMAN

*Attesting Officer*

*Commissioner of Patents and Trademarks*